United States Patent [19]

Arthur

[11] 4,361,912

[45] Dec. 7, 1982

[54] KARATE PROTECTIVE EQUIPMENT

[76] Inventor: Lawrence E. Arthur, 114 Middleboro Pl., Lynchburg, Va. 24502

[21] Appl. No.: 189,102

[22] Filed: Sep. 19, 1980

[51] Int. Cl.[3] ..... A41D 13/08

[52] U.S. Cl. ..... 2/18; 2/22; 36/106; 36/114

[58] Field of Search ..... 2/16, 18, 20, 22, 24, 2/161 A; 36/2 R, 96, 97, 102, 106, 113, 114, 9 R, 10, 72 R

[56] References Cited

U.S. PATENT DOCUMENTS

| | | | |
|---|---|---|---|
| 2,717,387 | 9/1955 | McMahan | 2/22 |
| 3,044,075 | 7/1962 | Rawlings | 2/22 |
| 3,259,910 | 7/1966 | Daignault | 2/24 |
| 3,465,365 | 9/1969 | Jones et al. | 2/24 |
| 3,769,722 | 11/1973 | Rhee | 36/2 R |
| 3,855,633 | 12/1974 | Rhee | 2/18 |
| 3,945,045 | 3/1976 | Rhee | 2/18 X |
| 3,949,493 | 4/1976 | Rhee | 36/2 R |
| 4,008,531 | 2/1977 | Schonbrun et al. | 36/106 |
| 4,051,613 | 10/1977 | Collins | 36/114 |
| 4,062,073 | 12/1977 | Rhee | 2/16 |
| 4,103,437 | 8/1978 | Dillard | 36/106 |
| 4,150,442 | 4/1979 | Boone | 2/24 X |
| 4,168,584 | 9/1979 | Wren et al. | 36/114 X |
| 4,190,971 | 3/1980 | Wren et al. | 36/114 X |
| 4,268,931 | 5/1981 | Salamon | 36/10 X |
| 4,287,610 | 9/1981 | Rhee | 2/18 |
| 4,290,147 | 9/1981 | Bruckner et al. | 2/18 |

*Primary Examiner*—Richard J. Scanlan, Jr.

*Attorney, Agent, or Firm*—Schwartz, Jeffery, Schwaab, Mack, Blumenthal & Koch

[57] ABSTRACT

Karate protective equipment including a glove, a boot and a shinguard, is formed of an outer soft foam material and selectively positioned harder, inner foam layers for added protection.

26 Claims, 17 Drawing Figures

KARATE PROTECTIVE EQUIPMENT

BACKGROUND OF THE INVENTION

1. Field of Invention

The invention relates to protective equipment, especially protective equipment used in the sport of karate. Specifically, the invention relates to a karate glove or punch, a karate boot or kick, and a karate shin-guard.

2. Prior Art

While various types of protective shoes and coverings have been developed, the prior art dealing with karate boots or kicks includes U.S. Pat. Nos. 3,667,140, 3,769,722, 3,949,493 and 4,103,437. U.S. Pat. Nos. 3,667,140 and 4,008,531 deal with a combined protective boot and shin-guard.

Examples of karate gloves are found in U.S. Pat. Nos. 3,855,633, 3,903,546 and 3,945,045. Other types of gloves, including boxing gloves, for the purpose of protecting the wearer and the person being struck, are also well known in the prior art.

The above references and other prior art have provided various means for protecting the combatants. In order to obtain the necessary protection, it was felt to be necessary to use thick foam material in the area that may come in contact with the opponent.

Also, the prior art devices had stress points which were disadvantageous in that the glove, for example, would tend to tear at certain of these points. Therefore, the protective gear would wear out and have to be replaced much sooner.

OBJECTS AND SUMMARY OF THE INVENTION

One object of the instant invention is to provide karate boots, gloves and shin-guards in certain areas with dual layers of material of varying strength, compression deflection and resiliency in order to protect the combatants and provide equipment which is not unduly cumbersome.

Another object is to provide karate protective equipment which does not have the stress points which create tearing as found in prior art devices.

A further object is to provide preformed, gloves, boots and shin-guards which will conform to the wearer's hands, feet and shins, respectively.

The objects are achieved by providing karate protective equipment including a glove, a boot and a shin-guard formed of an outer soft foam material and selectively positioned harder, inner foam layers for added protection. Essentially, the invention places additional foam material at points or areas of impact.

BRIEF DESCRIPTION OF THE DRAWINGS

The above and other objects will become more apparent from the following description and accompanying drawings, wherein.

DETAILED DESCRIPTION OF THE DRAWINGS

As will be seen throughout the disclosure, there is an outer, closed cell, foam material, and a relatively harder inner, closed cell, foam material. Both are preferably composed of vinyl/nitrile, both manufactured by Rubatex Corporation. Set out below is a table comparing the properties of the inner and outer vinyl (pvc/nitrile (NBR)):

| | INSIDE | OUTSIDE |
|---|---|---|
| Rubatex Stock No. | R-310-V | |
| | R-326-V | R-313-V |
| Specifications | | |
| ASTM D-1056-67 | SBE-41-42 | SBE-41 |
| ASTM D-1056-68 | SBE-41-42 | SBE-41 |
| ASTM D-1056-73 | RE-41-42-E2 | RE-41-E2 |
| ASTM D-1667-64 | VE-41-42 | VE-41 |
| MIL-C-3133B, MIL-STD-670B | SBE-3-7 | SBE-3 |
| MIL-P-24333 | Type 2 | — |
| Compression Deflection | | |
| (p.s.i.) | 4–8 | 2–5 |
| Shore 00 Durometer | | |
| (Approx. Average) | 40–60 | 20–40 |
| Density | | |
| (p.c.f.) Average | 5–10 | 5–10 |
| Water Absorption By Weight | | |
| (Max.) | 10% | 10% |
| Temperature Range (°F.) | | |
| Low (Flex without cracking) | +20° | 0° |
| High Continuous | 130° | 130° |
| High Intermittent | 200° | 200° |
| Compression Set (Average) | | |
| ASTM D-1056 ½" compressed 50% 22 hrs. @ 70° F. - 24 hrs. recovery | 15%–35% | 15%–35% |
| ASTM D-1667 ½" compressed 25% 22 hrs. @ 70° F. - 24 hrs. recovery | 10%–20% | 10%–20% |
| Heat Aging | | |
| (7 Days @ 158° F.) | | |
| Lineal Shrinkage (Max.) | 5% | 5% |
| Tensile Strength | | |
| (p.s.i. Min.) | 90 | 65 |

-continued

| | INSIDE | OUTSIDE |
|---|---|---|
| Elongation | | |
| (% Min.) | 175 | 175 |
| K Factor | | |
| (@ 75° F.) | | |
| Btu. · in./hr. · sq.ft. · °F. | 0.30 | 0.28 |
| Resilience | | |
| Bayshore (% Rebound Average) | | |
| (½" thickness @ 72° F.) | 12–18 | 28–38 |
| Thicknesses | Approx. ⅜" | Approx. ½" |

BOOT

Figure 1:
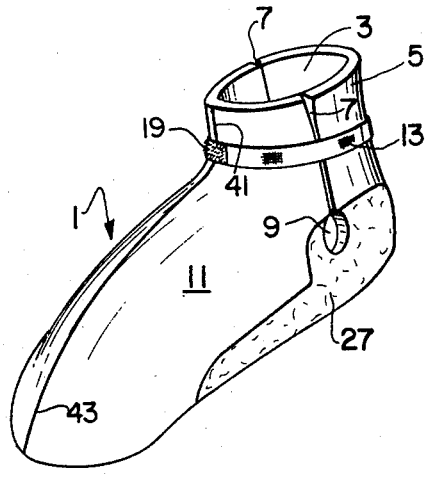
FIG. 1 is a perspective view of the boot according to the invention.
Figure 2:
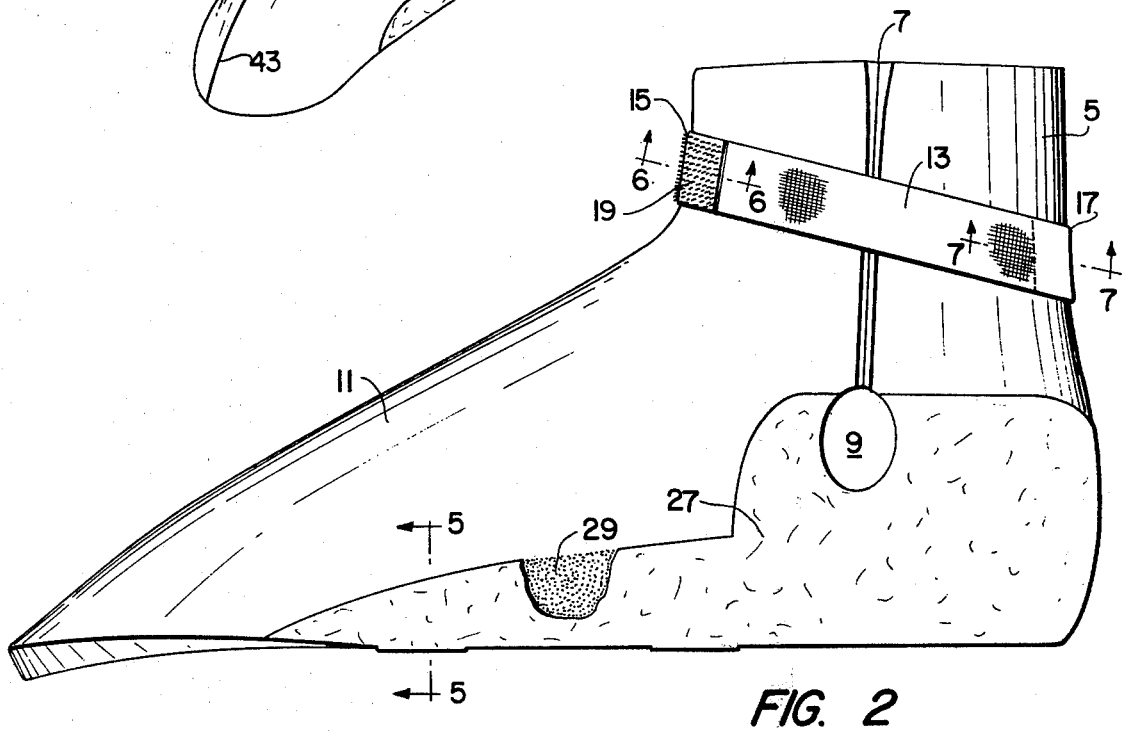
FIG. 2 is a side elevation view of the boot according to FIG. 1.

Referring now to FIG. 1, a fully enclosed boot 1 is shown having an upper opening 3 in an ankle support 5. A pair of slotted openings 7 extend from the top opening 3 to a pair of generally circular openings 9 adjacent to the wearer's ankle bone. Opening 9 provides for ease in spreading slots 7 to insert the wearer's foot and eliminates a sharp stress point. Further, the boot is easier to put on and take off since there are no laces. The remainder of the boot includes an upper 11 extending toward the toe of the boot. Finally, a strap 13 to be discussed in greater detail below is positioned around the ankle area.

The boot 1 is generally made of a molded plastic or rubber foam, preferably that referred to above as "OUTSIDE". An outer skin layer is formed by dipping or coating a vinyl casing over the foam. The material is preferably "Rubatex Formula 20700" vinyl copolymer. The outer casing also provides a smoooth, glossy cover for the foam material.

Referring to FIGS. 2, 4, 6 and 7, it will be seen that the strap 13 is adhesively secured to the upper, front portion of the ankle support at 15 and to the rear of the ankle support at 17. This can best be done by sewing the elastic to a piece of vinyl which in turn is adhesively secured to the vinyl coating on the boot. A conventional adhesive, such as Uniroyal "Ensolite to Ensolite and vinyl" may be used. The band 13 is made of elastic material so that upon pulling or enlarging the opening 3 and separating slots 7, the elastic expands to permit insertion of the wearer's foot and then contracts once the foot is completely inserted in the boot, thus, holding the ankle support portion 5 against the wearer's ankle and lower leg area.

Figure 8:
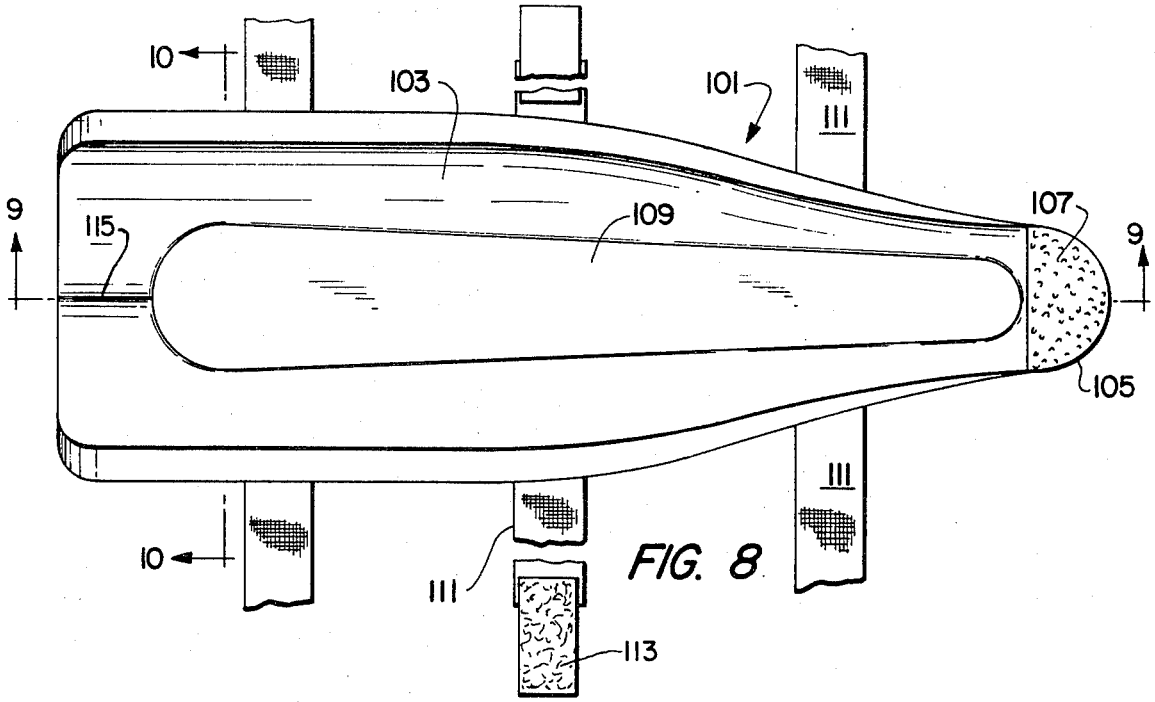
FIG. 8 is a top plan view of a shin-guard according to the invention.
Figure 9:
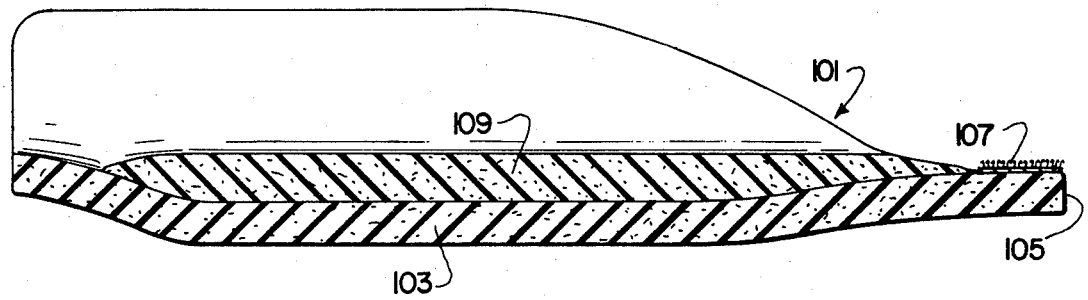
FIG. 9 is a cross-sectional view taken along lines 9—9 in FIG. 8.
Figure 10:
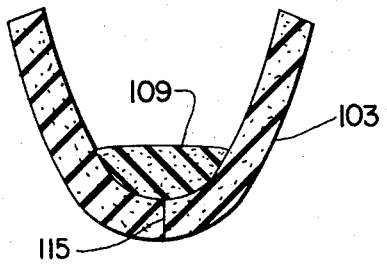
FIG. 10 is a cross-sectional view taken along lines 10—10 in FIG. 8.
Figure 11:
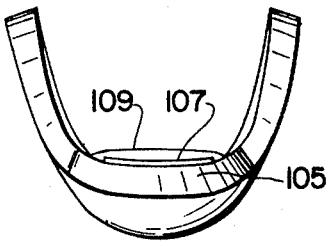
FIG. 11 is a bottom end view taken from the right side of FIG. 8.

The loop portion of a "VELCRO" brand fastener is seen at 19 for the purpose of meshing with a second hook portion on a shin-guard (see FIG. 8).

Figure 3:
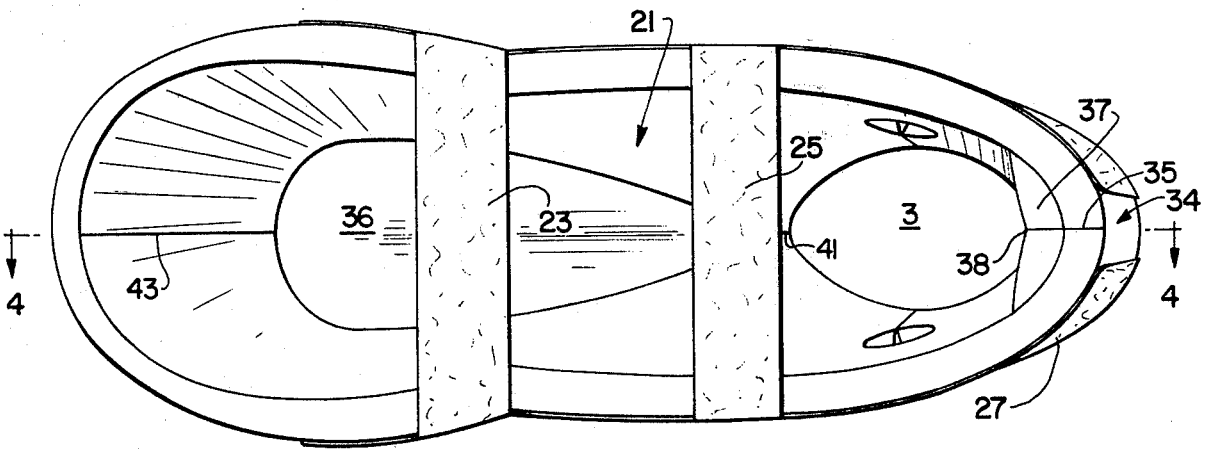
FIG. 3 is a bottom view of the boot shown in FIG. 2.
Figure 5:
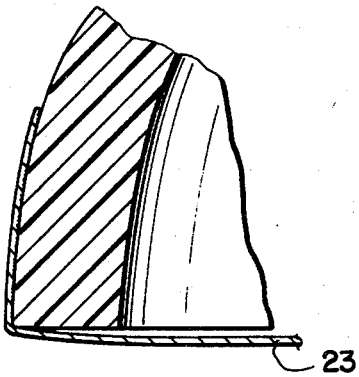
FIG. 5 is a section view taken along lines 5—5 in FIG. 2.
Figure 6:
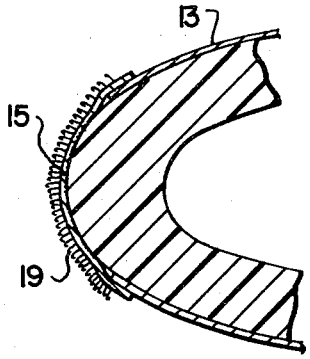
FIG. 6 is a section view taken along lines 6—6 in FIG. 2.
Figure 7:
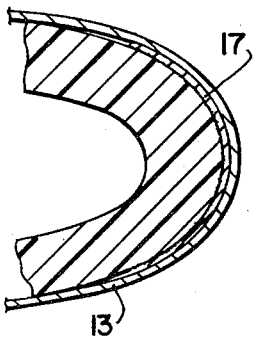
FIG. 7 is a section view taken along lines 7—7 in FIG. 2.

Referring to FIG. 3, it will be seen that the bottom of the boot is open at 21. A first front strap 23 in the general area of the ball of the wearer's foot extends across the bottom of the opening, and a second strap 25 extends across the bottom in the area of the arch of the wearer's foot. These straps 23 and 25 are a stretchable vinyl to accomodate various size feet of the wearer. The straps 23 and 25 are retained on the boot by foaming them integrally with portions 27 which are then adhesively secured to the side of the boot by means of adhesive 29 seen in FIGS. 2 and 5. The material 27 is cut out in the area of opening 9 and is formed of a single piece, separated at 34 at the rear of the heel, adjacent a dart joint at 35.

Figure 4:
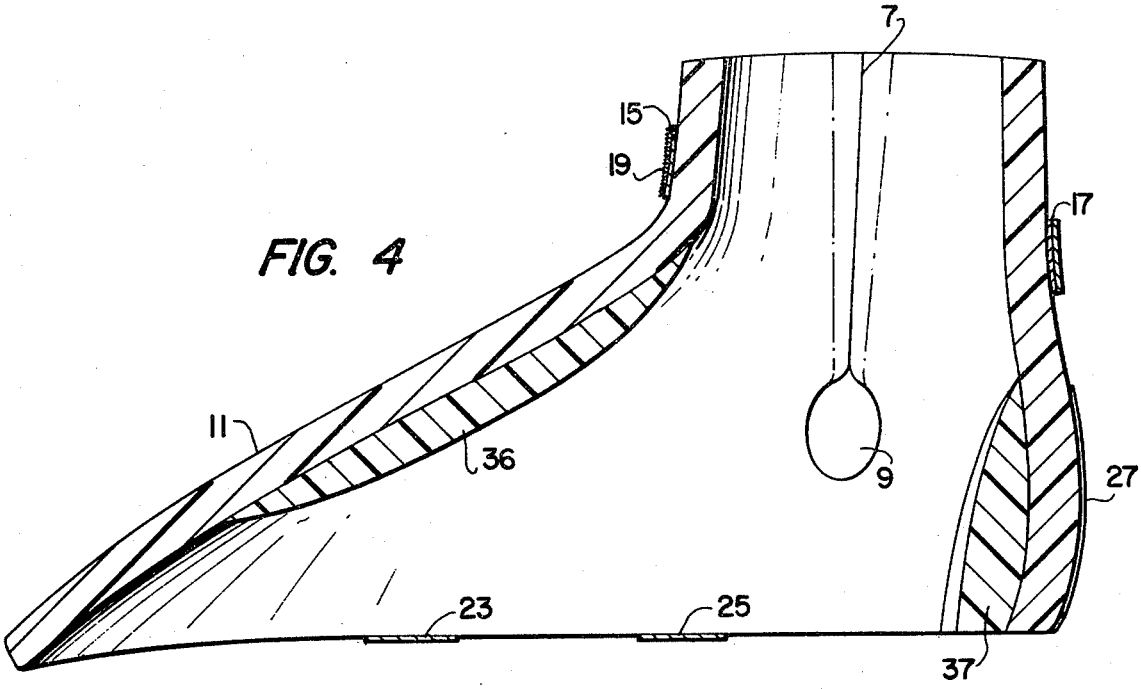
FIG. 4 is a section view taken along lines 4—4 in FIG. 3.

As seen in FIGS. 3 and 4, there is inserted a stiffening and protective portion 36 of "INSIDE" material on the inside of the portion 11 of the boot and a portion 37 at the heel of the boot which also has a dart joint 38 to conform to 34, 35. The purpose of this material, made of a harder vinyl/nitrite foam than the remainder of the boot is to protect the heel and instep, as well as injury to an opponent.

The boot is shaped by means of a plurality of darts formed by removing narrow triangular portions from the foam and adhesively bonding the edges created by the removal. These are seen at 35 and 38 in the heel, 41 on the upper which extends to 43 toward the toe area. The stiffening material also assists in the forming.

SHIN-GUARD

Referring now to FIGS. 8–11 a shin-guard 101 has a generally curved, formed portion 103 tapered toward a rounded end 105. The shin-guard is designed to extend from below the knee to the top of boot 1 illustrated in FIGS. 1–7. Adjacent the end 105 is a loop or pile portion 107 adhesively secured to portion 105. The purpose of the fastener is to join element 19 in FIGS. 1, 2, 4 and 6. A harder foam formed of the same "INSIDE" material (as 35 and 37 in the boot) is seen as an elongated member 109 adhesively secured to portion 103. Elastic straps 111 with "VELCRO" brand fasteners 113 sewn thereon are retained by adhesive to two, and preferably three, locations on the shin-guard in the same manner as strap 13 on the boot.

The shin-guard is formed of the same material and in the same manner as boot 1. It is formed to conform to the general shape of the wearer's leg. This will help prevent the shin-guard from rotating on the wearer's leg. The curved, forming is achieved by means of a dart 115 formed by removing a narrow triangular piece in the area ajdacent numeral 115, drawing the two edges created by the removal and adhesively bonding them together. The insertion of the material 109 further assists in the shaping in view of the fact that it is of a given size and bonded to the pre-curved outer material.

GLOVE

Figure 12:
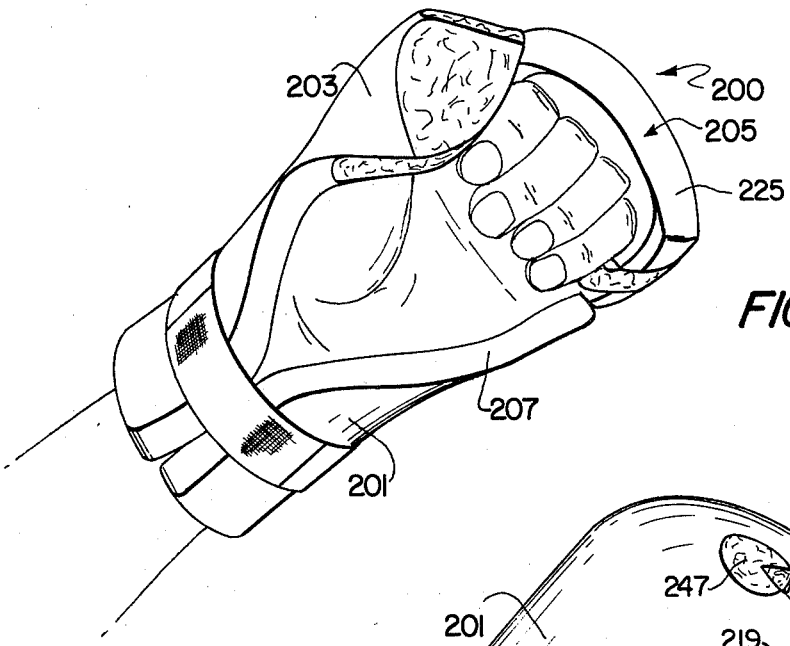
FIG. 12 is a bottom perspective view of a glove according to the invention, the glove being shown on the hand of a wearer.
Figure 13:
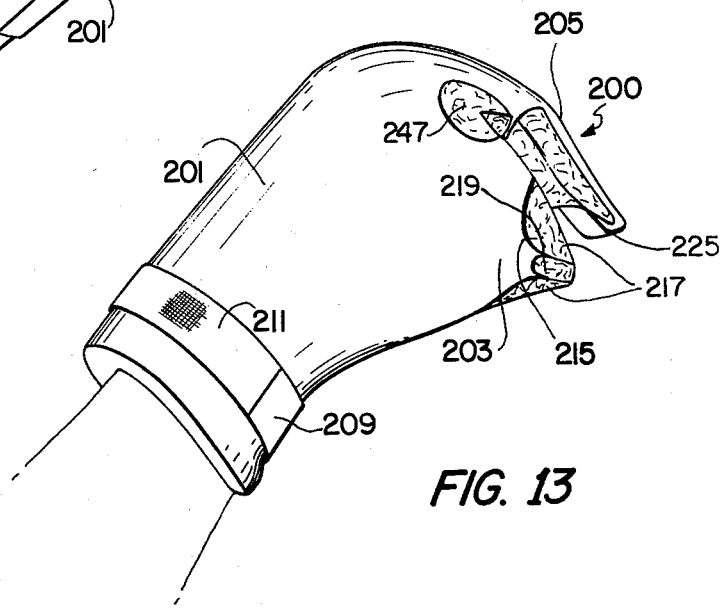
FIG. 13 is a top perspective view of the glove of FIG. 12 on a wearer.
Figure 17:
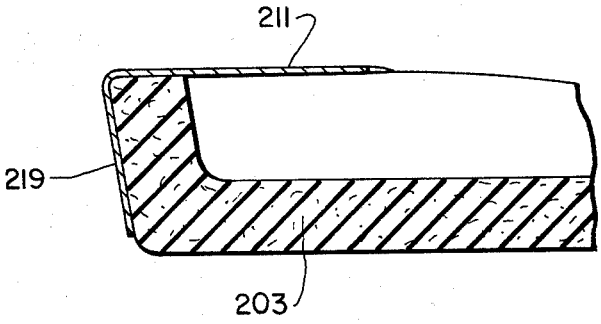
FIG. 17 is a cross-section view taken along lines 17—17 in FIG. 14.
Figure 14:
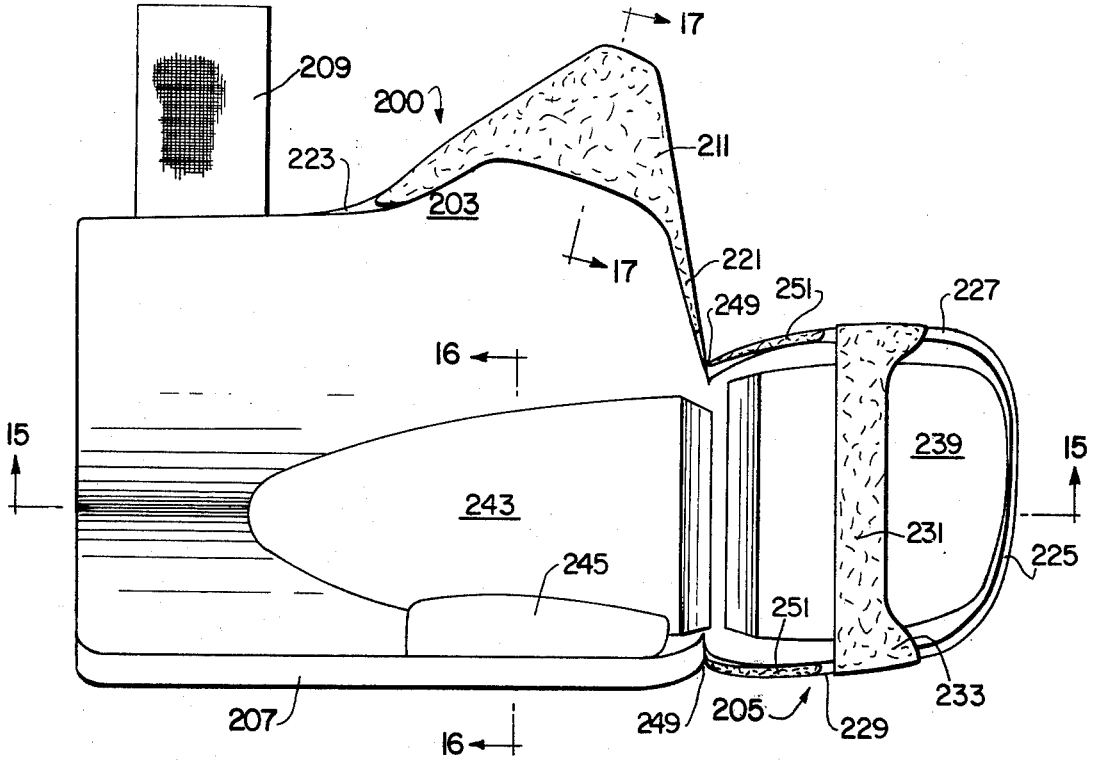
FIG. 14 is a view of the inside of the glove.

Referring now to FIGS. 12–17, a glove 200 is seen in various positions, FIGS. 12 and 13 illustrating the glove on a wearer's hand.

The glove 200 is molded of "OUTSIDE" foam material and includes a wrist portion 201 which substantially encircles the wrist. Coextensive with one side is a thumb protective portion 203, and extending from the end is a finger protective portion 205. On the side opposite the thumb portion is a side hand protective portion 207. An elastic strap 209 is secured to the wrist portion by means of vinyl material to which it is switched or adhesively secured and which in turn is adhesively secured to the wrist portion 201 in the same manner as strap 13. Therefore, the glove does not open and come off during use. Also, it is easier to put the glove on than with the prior art gloves.

A thumb retaining means 211 is formed by means of a piece of vinyl material adhesively attached to portion 203. An upper portion 215 in turn is formed by means of a dart in the end to form a thumb recess of a size and shape generally conforming to the thumb with vinyl 211 retaining the thumb therein. There are a pair of vinyl strips 217 extending over foam thumb portion 215, and a third center vinyl strip 219, between strips 217 and covering the thumb forming dart. The strips are integral and coextensive with vinyl 211, as are edge portions 221 and 223. The thumb design protects wearer's thumb and prevents injury to an opponent because it is always covered.

The finger portion 204 is shaped with a blunt forward edge 225 substantially covering the fingers when the first is closed as seen in FIG. 13. A pair of side edges 227 and 229 are designed to substantially meet the forward edges of thumb portion 203 and side 207, respectively.

A finger grip or grab bar 231 extends across the inside of portion 205. The grip 231 is formed from vinyl 233 wrapped around a soft foam ("OUTSIDE") material 235. A pair of outside edges of the vinyl extend over the edges 227 and 229 part of the distance over the outside of the portion 205 as seen at 237 in FIG. 15. By providing the grab bar as disclosed, the wearer must strike with the proper portion of the hand when a fist is made.

Figure 15:
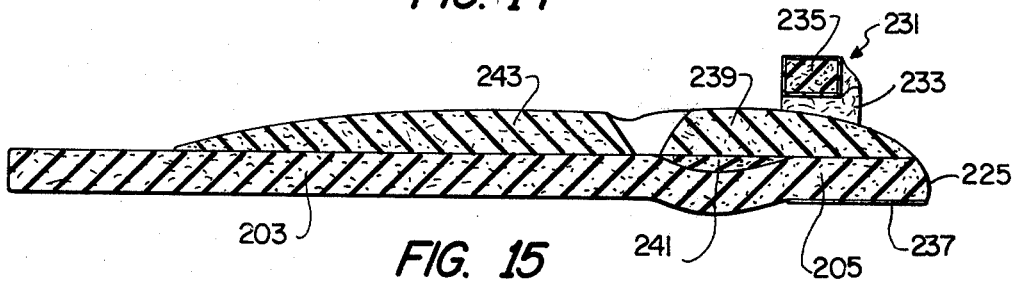
FIG. 15 is a cross-section view taken along lines 15—15 in FIG. 14.
Figure 16:
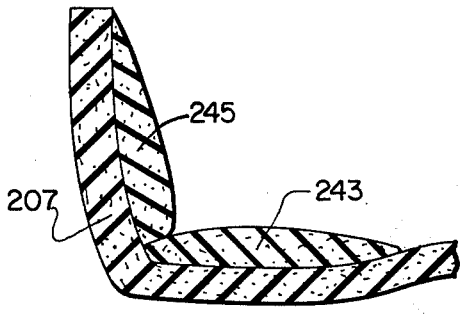
FIG. 16 is a cross-section view taken along lines 16—16 in FIG. 14.

Additional "INSIDE" protective foam material 239 is adhesively secured to the inside of finger portion 205. To give proper form and to add additional protection to the finger area a piece of "OUTSIDE" foam 241 seen in FIG. 15 is adhesively sandwiched between material 239 and 205. "INSIDE" protective material is also adhesively secured at 243 and 245 on member 201 and side portion 207, respectively. By adhesively bonding the members 243 and 245 together the side 207 is essentially pre-formed to generally a right angle to the main portion 201.

Vinyl reinforcing to protect stress areas from tearing are seen in FIG. 13 at 247. The reinforcing which is placed at corners 249 (see FIG. 14) each have a forwardly extending piece 251 extending along edges 227 and 229.

Finally, since there is little movement between the open and closed position, there is limited radial distortion because the glove is formed in the partially closed position.

The glove, as are the boot and shin-guard, are dipped or otherwise coated (as discussed above) to provide an outer casing over the protective foam. The casing will help protect the foam and will further assist in protecting the various vinyl pieces. The preferred type of coating is a vinyl copolymer solution, developed for example by Rubatex Corporation. The material (sold under "Rubatex Formula 20700") is designed to provide a protective surface for closed cell vinyl foam rubbers of the type used herein. The protective gear is fabricated and subsequently dipped into the coating which may have a coloring agent added.

While several embodiments of the invention have been described, it will be understood that it is capable of still further modifications and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. Protective equipment for use in karate and the like comprising:

(a) a first, outer, relatively large formed, foam material formed in the shape of a glove having inner and outer surfaces for conforming to and protecting the hand of the wearer, said first foam material being relatively soft; and (b) a second inner relatively harder formed foam material secured to the inner surface at areas of impact.

2. Protective equipment as defined in claim 1 including a wrist encircling portion and an elastic strap encircling said wrist portion.

3. Protective equipment as defined in claim 1 including a first protective side portion and a thumb receiving recess therein, a second protective side portion opposite said first protective side portion, a finger protective portion extending forward of said side portions, and means on said finger protective portion for drawing said finger protective portion toward said side portions whereby the hand of the wearer is essentially completely enclosed within the glove.

4. Protective equipment as defined in claim 3 wherein said drawing means includes finger gripping means formed by foam wrapped within sheet material secured to said finger protective portion.

5. Protective equipment as defined in claim 3 wherein said second inner foam material is positioned on the inner surface of said finger protective portion.

6. Protective equipment as defined in claim 3 wherein said second inner foam material is positioned on the inner surface of one of said side portions.

7. Protective equipment as defined in claim 3 wherein said second inner foam material is positioned on the inner surface of the glove between said side portions.

8. Protective equipment as defined in claim 3 wherein said second inner foam material is positioned on the inner surface of the glove and includes a first piece on the side portion opposite the thumb and a second piece secured thereto and to the inner surface of the glove between the side portions whereby the glove is formed with the side portion opposite the thumb at substantially a right angle to said second piece.

9. Protective equipment as defined in claim 3 including reinforcing means between said side portions and said finger protective portion for resisting stress and tearing.

10. Protective equipment as defined in claim 3 wherein said thumb recess is formed by inserting a dart therein to form a curved top portion and a thumb retaining means formed by sheet material enclosing the area formed by the curved top portion and including extensions on said sheet material extending along the side portions on which the thumb recess is formed and extending over the outer surface of the curved top portion.

11. Protective equipment for use in karate and the like comprising:

(a) a first, outer, relatively large formed, foam material formed in the shape of a shin-guard having inner and outer surfaces for conforming to and protecting the shin of the wearer, said first foam material being relatively soft; and (b) a second inner relatively harder formed foam material secured to the inner surface at areas of impact.

12. Protective equipment as defined in claim 11 wherein said shin-guard is elongated and wherein said inner foam material includes an elongated member secured substantially centrally on the inner surface of said outer foam material.

13. Protective equipment as defined in claim 12 wherein said shin-guard is formed in a curve to conform to the wearer's leg by inserting a dart at one end thereof.

14. Protective equipment as defined in claim 12 including a fastener at one end thereof for joining to a complementary fastener on the top of a boot.

15. Protective equipment as defined in claim 14 wherein said fasteners are of the hook and pile type.

16. Protective equipment as defined in claim 12 including a plurality of leg encircling straps thereon.

17. Protective equipment for use in karate and the like comprising:

(a) a first, outer, relatively large formed, foam material formed in the shape of a boot having a heel and an upper, and further having inner and outer surfaces for conforming to and protecting the foot of the wearer, said first foam material being relatively soft; and (b) a second inner relatively harder formed foam material secured to the inner surface at areas of impact.

18. Protective equipment as defined in claim 17 including a strap encircling the ankle support.

19. The protective equipment as defined in claim 17, wherein said second inner formed foam material is adhesively secured to said inner surface.

20. Protective equipment as defined in claim 17 or 19 wherein said outer foam material has a compression deflection of approximately 2–5 p.s.i., a tensile strength of approximately 65 p.s.i. min. and a resilience of approximately 28–38 Bayshore (% rebound average, ½" thickness at 72° F.); and said inner foam material has a compression deflection of approximately 4–8 p.s.i., a tensile strength of approximately 90 p.s.i. min. and a resilience of approximately 12–18 Bayshore (% rebound average, ½" thickness at 72° F.).

21. Protective equipment as defined in claim 17 or 19 further including said inner foam material on the inner surface of the heel.

22. Protective equipment as defined in claim 17 or 19 wherein said boot has a substantially open bottom, foot retaining means including a pair of side panels secured to the sides of said boot, and a pair of integral straps extending between said side panels across the open bottom.

23. Protective equipment as defined in claim 17 or 19 including an ankle support, a pair of slotted openings extending from a top opening in the ankle support to a pair of generally circular openings in the side of the boot adjacent the wearer's ankle bone.

24. Protective equipment as defined in claim 17 or 19 including a fastener adjacent the top of the boot for cooperating with a complementary fastener on a shinguard.

25. Protective equipment as defined in claim 1, 11 or 17 including a protective casing coated thereon.

26. Protective equipment as defined in claim 1, 11 or 17 wherein said second foam material has greater compression deflection and higher tensile strength and is less resilient relative to said outer foam material.

* * * * *